US012523138B2

(12) United States Patent
Qi et al.

(10) Patent No.: US 12,523,138 B2
(45) Date of Patent: Jan. 13, 2026

(54) AUTONOMOUS START OF PUMP-DOWN OPERATION

(71) Applicant: Halliburton Energy Services, Inc., Houston, TX (US)

(72) Inventors: Yuan Qi, Houston, TX (US); Sudhir Gupta, Houston, TX (US); Ritesh Dharmendra Panchal, Houston, TX (US); Neil Alan Ostermann, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 51 days.

(21) Appl. No.: 18/544,145

(22) Filed: Dec. 18, 2023

(65) Prior Publication Data

US 2024/0218779 A1 Jul. 4, 2024

Related U.S. Application Data

(60) Provisional application No. 63/436,037, filed on Dec. 29, 2022.

(51) Int. Cl.

| | |
|---|---|
| ***E21B 7/04*** | (2006.01) |
| ***E21B 44/06*** | (2006.01) |
| ***E21B 47/13*** | (2012.01) |

(52) U.S. Cl.

CPC ..... *E21B 44/06* (2013.01); *E21B 7/046* (2013.01); *E21B 47/13* (2020.05); *E21B 2200/20* (2020.05)

(58) Field of Classification Search

CPC ..... E21B 44/06; E21B 7/046; E21B 47/13; E21B 2200/20

(Continued)

(56) References Cited

U.S. PATENT DOCUMENTS 3,828,437 A * 8/1974 Heselwood ..... G01B 5/043 33/744
4,117,600 A * 10/1978 Guignard ..... G01B 7/26 33/735

(Continued)

FOREIGN PATENT DOCUMENTS

AU 2021477258 A1 * 3/2024 ..... E21B 23/08
CA 3154977 A1 * 10/2021 ..... G06N 3/086

(Continued)

OTHER PUBLICATIONS

Halliburton Auto Pumpdown Service, Consistent, efficient plug-and-perf operations every well, every crew, every time, H014451, Apr. 2023.

(Continued)

*Primary Examiner* — Robert F Long
(74) *Attorney, Agent, or Firm* — John Wustenberg; C. Tumey Law Group PLLC

(57) ABSTRACT

Disclosed herein are systems and methods for automating a start of a pump-down operations that adjusts a pump rate and a winch speed. The methods include lowering a tool string into a wellbore via a wireline controlled by a winch unit and a pump unit, measuring at least one measurement parameter, calculating a range of wireline tension references for the winch unit from at least inputs comprising at least one user configuration parameter and the at least one measurement parameters, and a range of wireline tension references for the pump unit from at least inputs comprising at least one user configuration parameter and the at least one measurement parameters, generating a tension error signal when the measured tension of the wireline deviates from at least one of the calculated ranges of wireline tension references, and adjusting the lowering of the downhole tool string in response to the tension error signal.

12 Claims, 8 Drawing Sheets

(58) Field of Classification Search
USPC ..... 173/1–2, 8, 13, 18–20, 184, 25–31, 173/38–39, 45–53; 227/1–2, 8–19, 51, 227/63–64, 77–82, 99, 107, 140, 156
See application file for complete search history.

(56) References Cited

U.S. PATENT DOCUMENTS 4,242,017 A * 12/1980 De Fazio ..... B23B 49/02 901/41
4,347,692 A * 9/1982 Culver ..... E04H 12/34 173/195
4,487,271 A * 12/1984 Pomeroy ..... B27B 17/0016 144/35.2
4,595,065 A * 6/1986 Wada ..... E21B 15/04 175/85
4,626,138 A * 12/1986 Boyes ..... E02D 7/20 405/230
5,213,169 A * 5/1993 Heller ..... E21B 21/12 175/215
5,256,003 A * 10/1993 Ito ..... E02D 3/106 405/232
5,570,975 A * 11/1996 Reinert, Sr. ..... E02D 7/26 173/184
5,848,859 A * 12/1998 Clark ..... G05B 19/404 901/41
6,012,877 A * 1/2000 McCowin ..... B23B 49/02 901/41
6,216,789 B1 * 4/2001 Lorsignol ..... E21B 19/09 254/266
7,458,421 B2 * 12/2008 Barrow ..... E21B 47/04 166/66
7,770,639 B1 * 8/2010 Pledger ..... E21B 47/04 166/254.1
8,562,257 B2 * 10/2013 Westerbeek ..... E02D 7/02 173/207
9,410,419 B2 * 8/2016 Coles ..... E21B 47/007
9,657,540 B2 5/2017 Coles et al.
10,858,797 B2 * 12/2020 Jussel ..... G01P 3/54
11,454,076 B2 9/2022 Ludwig et al.
11,499,372 B2 11/2022 Qi et al.
11,534,921 B2 * 12/2022 Barnes ..... B25J 9/12
2001/0041099 A1 * 11/2001 Kato ..... E02D 7/20 405/257
2002/0077753 A1 * 6/2002 Kelly ..... G01V 11/002 702/1
2002/0198661 A1 * 12/2002 Strickland ..... E21B 47/04 702/6
2005/0232714 A1 * 10/2005 Ferrari ..... B23Q 17/2233 408/97
2008/0302549 A1 * 12/2008 Zeiler ..... B23Q 17/0985 408/239 R
2009/0127525 A1 * 5/2009 Teurlay ..... B66D 1/505 254/274
2009/0301723 A1 * 12/2009 Gray ..... E21B 23/00 166/301
2011/0139475 A1 * 6/2011 Braun ..... B25D 17/26 173/112
2011/0172923 A1 * 7/2011 Van Os ..... E21B 45/00 73/152.01
2011/0313724 A1 * 12/2011 Dalton ..... G01B 21/18 73/11.03
2012/0020756 A1 * 1/2012 Zagar ..... B23Q 3/002 409/233
2012/0305315 A1 * 12/2012 Bedouet ..... E21B 33/124 175/50
2013/0138254 A1 * 5/2013 Seals ..... E21B 7/068 175/2
2014/0202691 A1 * 7/2014 Coles ..... E21B 47/01 166/255.1
2014/0374089 A1 * 12/2014 Coles ..... G05D 7/0617 700/282
2015/0027736 A1 * 1/2015 Smaardyk ..... E21B 47/007 166/381
2015/0167414 A1 * 6/2015 Coles ..... E21B 47/12 166/250.01
2015/0330172 A1 11/2015 Allmaras et al.
2016/0229672 A1 8/2016 Breard et al.
2016/0290077 A1 * 10/2016 Aske ..... G05B 15/02
2017/0241221 A1 * 8/2017 Seshadri ..... E21B 47/024
2017/0314353 A1 * 11/2017 Viassolo ..... E21B 23/14
2018/0051540 A1 * 2/2018 Castillo ..... E21B 47/007
2018/0135398 A1 * 5/2018 Entchev ..... E21B 44/005
2018/0178366 A1 * 6/2018 Matei ..... B25B 21/00
2018/0326507 A1 * 11/2018 Halvorsen ..... B25J 9/1679
2018/0334898 A1 * 11/2018 Zha ..... E21B 44/02
2019/0203575 A1 7/2019 Schlosser
2020/0056473 A1 * 2/2020 Bolt ..... E21B 47/09
2020/0149241 A1 * 5/2020 Flanigan ..... E02D 13/00
2020/0224508 A1 * 7/2020 Chapman ..... E21B 47/008
2020/0270979 A1 * 8/2020 Hradecky ..... G05B 15/02
2021/0164309 A1 * 6/2021 Ludwig ..... E21B 23/14
2021/0245353 A1 * 8/2021 Crowell ..... B25F 5/00
2021/0262303 A1 * 8/2021 Venna ..... E21B 43/128
2021/0370456 A1 * 12/2021 Sonntag ..... B23Q 11/0046
2022/0193874 A1 * 6/2022 Ramezanian ..... B25F 5/006
2023/0038625 A1 2/2023 Wu et al.
2023/0058152 A1 2/2023 Qi et al.
2023/0092758 A1 * 3/2023 Dyess ..... E21B 47/09 166/255.2
2023/0175388 A1 * 6/2023 Song ..... F04B 49/065 166/244.1
2023/0297920 A1 * 9/2023 Morgan ..... E21B 47/00 705/7.37
2023/0383644 A1 * 11/2023 Duncan ..... E21B 41/00
2023/0417116 A1 * 12/2023 Duncan ..... E21B 23/08
2024/0011386 A1 * 1/2024 Wheater ..... E21B 47/04
2024/0218783 A1 * 7/2024 Qi ..... E21B 47/09
2024/0246215 A1 * 7/2024 Burnett ..... B25F 3/00
2024/0280978 A1 * 8/2024 Venna ..... E21B 23/14
2025/0020029 A1 * 1/2025 Bu ..... E21B 19/008
2025/0075570 A1 * 3/2025 Golinowski ..... E21B 47/022
2025/0075608 A1 * 3/2025 Husband ..... E21B 43/26

FOREIGN PATENT DOCUMENTS

WO WO-2017123249 A1 * 7/2017 ..... E21B 23/00
WO WO-2021163656 A1 * 8/2021 ..... E21B 23/06
WO WO-2024124069 A2 * 6/2024 ..... E21B 47/009
WO WO-2025049663 A1 * 3/2025 ..... E21B 43/00

OTHER PUBLICATIONS

International Search Report and Written Opinion for International Patent Application No. PCT/US2023/085265 dated Apr. 16, 2024. PDF file. 9 pages.

* cited by examiner

AUTONOMOUS START OF PUMP-DOWN OPERATION

CROSS REFERENCE TO RELATED APPLICATIONS

This application claims the priority of U.S. Provisional Patent Application No. 63/436,037, filed Dec. 29, 2022, which is incorporated by reference in its entirety.

BACKGROUND

Wells are drilled onshore and offshore to recover natural deposits of oil, gas, and other natural resources that are trapped in subterranean formations in the Earth's crust. Testing and evaluation of completed and partially finished wells are used to collect information to increase well production and return on investment. Downhole measurements of formation pressure, formation permeability, and recovery of formation fluid samples, may be useful for predicting economic value, production capacity, and production lifetime of geological formations. Further, perforating, fracturing, and other intervention operations in completed wells may also be performed to optimize well productivity.

Downhole tools, such as plugging and perforating tools, may be utilized to set a plug within a well to isolate a subterranean formation surrounding the wellbore from another subterranean formation and then perforate a casing and the isolated subterranean formation to prepare the well for production. The plugging and perforating tools may be included as part of the tool string and deployed downhole along with other downhole tools. The tool string may be conveyed along the wellbore by applying controlled tension to the tool string from a wellsite surface via a conveyance line or other conveyance means.

In some downhole applications, such as in horizontal or otherwise deviated wellbores or when multiple bends are present along the wellbore, water or another fluid may be pumped into the wellbore above (or behind) the tool string to push or "pump-down" the tool string to an intended depth along the wellbore. During pump-down operations, downhole tool strings are deployed from the surface to a desired depth in a lateral wellbore via fluid pumped by one or more pump units at surface. The downhole tool strings are connected to a wireline, which is driven by a winch unit at surface. Generally, wellbores have one vertical section that provides access from surface to certain depth and one or more horizontal sections (e.g., lateral wellbores) deviated from the vertical section. In the lateral wellbores, gravity may not provide a driving force to move the downhole tool strings. Therefore, the pump-down operations are used to drive the downhole tool strings. Specifically, the pump-down operations coordinate the winch and pump units to drive the downhole tool strings in horizontal sections.

Downhole conveyance of the tool string is managed by a wellsite operator who monitors and controls depth, speed, and/or other downhole parameters of the tool string. Pumping operations are managed by another wellsite operator who monitors and controls flow and pressure of the pumped fluid based on the depth, speed, and/or other downhole parameters of the tool string being conveyed. The wellsite operators visually monitor their equipment via corresponding control panels at the wellsite surface to identify detrimental or otherwise undesirable operational parameters or events, as well as to manually implement processes to counteract such parameters or events via the corresponding control panels. An example of an undesirable operational event may include a "pump-off" event, during which excessive fluid pressure above the tool string causes excessive tension of the conveyance line, thereby causing a cable head of the tool string to disconnect the conveyance line from the tool string. Another undesirable operational event may also include a "stick-slip" event, during which the tool string systematically sticks to and slips along a sidewall of the wellbore, slowing down the rate at which the tool string progresses along the wellbore, among other potentially adverse effects.

For horizontal or deviated wells, an operator starts the pump unit when the downhole tool strings reach a landing point in the horizontal section of the wellbore. For a successful pump-down operation, the operators need to maintain the wireline tension when the tool string reaches the landing point. The operator of the pump unit and the operator of the winch unit need to coordinate closely to control pump unit and winch unit accordingly. Indeed, wireline tension may change significantly as the downhole tool string transitions from a vertical section of the wellbore to the lateral section. In the vertical section, the wireline may support the weight of the tool string, which puts the wireline in tension. However, in the lateral section, the wellbore may support a significant portion of the weight of the tool string, which may require adjusting the pump unit and/or wireline to maintain a desired tension in the wireline such that the tool string may advance smoothly in the horizontal section. Unfortunately, human error may result in the pump unit and/or winch unit being over or under adjusted, which may adversely affect completion operations.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
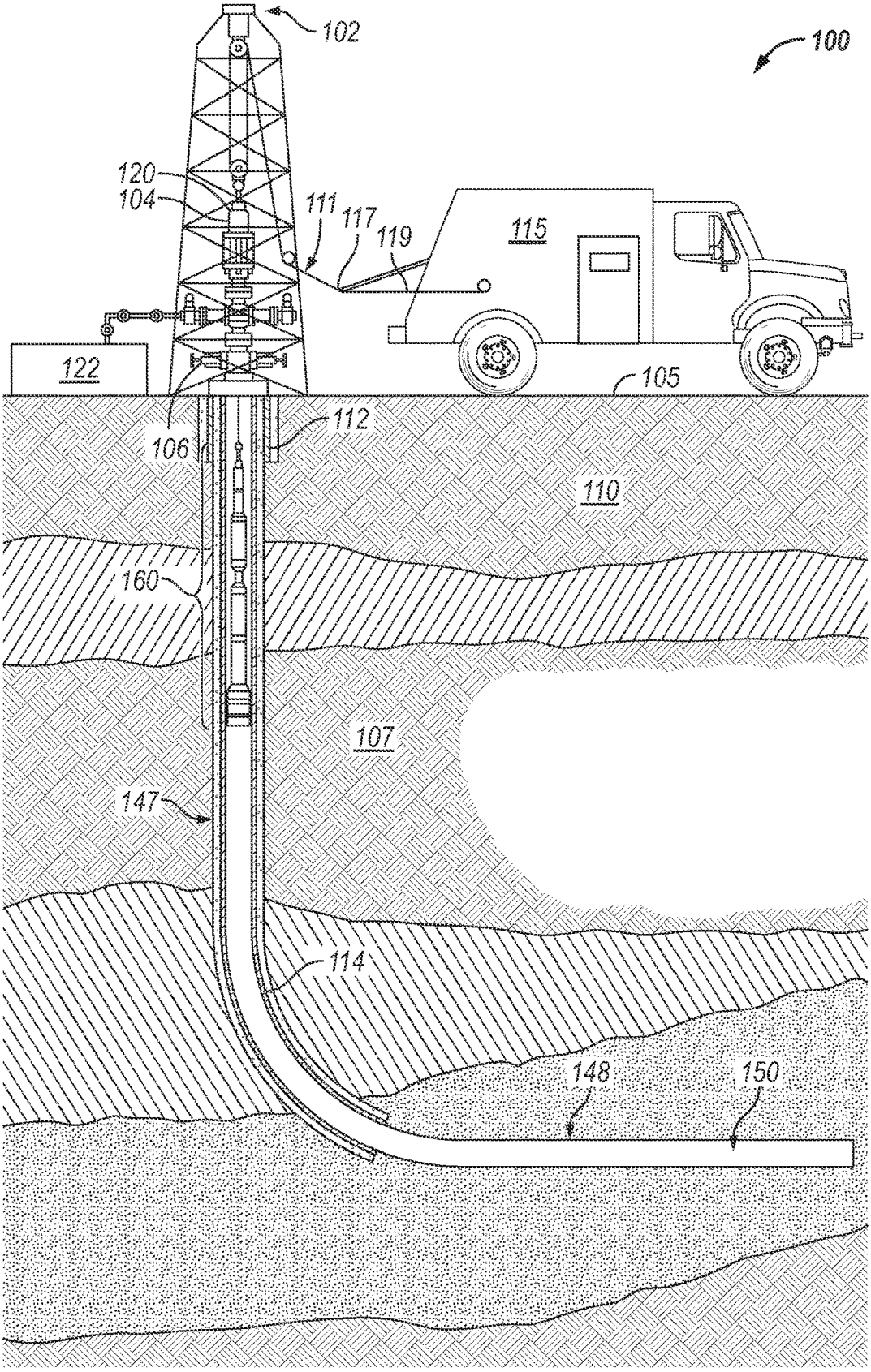
FIG. 1 illustrates a side schematic of a downhole operation, in accordance with some embodiments of the present disclosure.

Disclosed herein are systems and methods for automating a pump-down start operation and, more particularly, example embodiments may include an automated pump-down start system that adjusts a fluid rate and a winch speed at a transition from a vertical section to a lateral or horizontal section of a wellbore. Automating the pump-down operation at the transition (e.g., at the rapid trajectory changes in the wellbore) may accurately and reliably maintain wireline tension in a desired range while avoiding slowing or stopping the winch unit, which may reduce operation costs, as well as reduce risk of human error during operation.

As previously noted for horizontal or deviated wells, an operator starts the pump unit before the downhole tool strings reach a landing point in the horizontal section of the wellbore. For a successful pump-down operation, the operators typically need to maintain the wireline tension when the tool string reaches the landing point. The operator of the pump unit and the operator of the winch unit need to coordinate closely to control the pump unit and the winch unit accordingly. Indeed, wireline tension may change significantly as the downhole tool string transitions from a vertical section of the wellbore to a lateral section. In the vertical section, the wireline may support the weight of the tool string, which puts the wireline in tension. However, in the lateral section, the wellbore may support a significant portion of the weight of the tool string, which may require adjusting the pump unit and/or wireline to maintain a desired tension in the wireline such that the tool string may advance smoothly in the horizontal section. Unfortunately, human error may result in the pump unit and/or winch unit being over or under adjusted, which may adversely affect completion operations.

The adjustments of the fluid rate and the winch speed at a transition from a vertical section to a lateral or horizontal section of a wellbore includes estimation of the time delay from the time of command issuance to time when the tool string reacts to the command. In embodiments, automating the pump-down operation at the transition (e.g., at the rapid trajectory changes in the wellbore) may accurately and reliably maintain wireline tension in a desired range while avoiding slack or over stretched. In the transition section from the vertical section to the horizontal section of the wellbore, the wireline tension can change dramatically in a short period of time due to intermittent contact between the downhole tool and the casing. As the downhole tool contacts the casing, the downhole tool is supported and the wireline tension drops. As the wireline tension drops, the downhole tool may still be able to move due to its own weight. If the downhole tool does not move due to its own weight, little fluid rate may be needed to drive it downhole and for the winch to maintain its speed. However, the downhole tool may be stuck against the casing causing the wireline to slack if the fluid rate doesn't increase. Therefore, it is important to command the winch to slow down so to avoid wireline slack under this condition. In some embodiments, the wireline tension target is adjusted automatically as a function of the downhole tool position in the wellbore.

In some embodiments, automating the pump-down operation may include estimation of the time delay from the time of command issuance to time when the tool string reacts to the command. For instance, a fluid rate delay time from surface to the downhole tool string may be calculated by dividing the measured or desired depth of the downhole tool string by the speed of fluid traveling in the wellbore, wherein the downhole tool string is in contact with the wellbore fluid. Automating the pump-down operation may include calculating the winch stop depth by subtracting the product of total delay time of a winch unit and a current line speed to the target depth, wherein the total delay time comprises at least the response delay time of the winch unit. Automating the pump-down operation may include calculating pump stop depth by subtracting the product of total delay time of a pump unit and a current line speed to the target depth. The total delay time of the pump unit and the current line speed comprises response delay time of the pump unit, response delay time of a winch unit, response delay time of a fluid rate from surface to downhole, and any combination thereof. Automating the pump-down operation may include regulating automatically a winch controller and a pump controller simultaneously to stop the downhole tool string at a target depth which comprises calculating a pump stop depth and a winch stop depth separately and/or by including different received inputs. Automating the pump-down operation may include regulating automatically a winch controller and a pump controller simultaneously to stop the downhole tool string at a target depth comprises maintaining the wireline tension within a safety range. Alternatively, automating the pump-down operation may include regulating automatically a winch controller and a pump controller and stopping the pump unit before or after the winch unit. Automating the pump-down operation may include regulating automatically a pump controller to a minimum fluid rate output at the calculated pump stop depth in the case of a toe-up wellbore condition. The minimum fluid rate can be given by the user input, or through modeling or static calculation.

FIG. 1 illustrates a schematic of a downhole operation 100, in accordance with some embodiments of the present disclosure. In general, surface equipment provides power, material, and structural support for the operation of the pump down downhole tool string 160. The surface equipment may include a drilling rig 102 and associated equipment, such as a data logging and control truck 115. Control truck 115 may comprise a winch controller (not shown), a winch control unit (not shown), and a control panel (not shown). Rig 102 may include equipment such as a rig pump 122 disposed proximal to the rig 102. The rig 102 can include equipment used when a well is being logged or later perforated such as a tool lubrication assembly 104 and a pack off pump 120. In some implementations, a blowout preventer will be attached to a casing head 106 that is attached to an upper end of a well casing 112. Rig pump 122 provides pressurized drilling fluid to the rig and some of its associated equipment. Control truck 115 monitors the data logging operation and receives and stores logging data from the logging tools and/or controls and directs perforation operations. Below rig 102 is the wellbore 150 extending from the surface 105 into the earth 110 and passing through a plurality of subterranean geologic formations 107. Wellbore 150 penetrates through the formations 107 and in some implementations forms a deviated path, which may include a vertical section 147 and a horizontal section 148. Wellbore 150 may be reinforced with one or more casing strings 112 and 114.

The downhole tool string 160 may be attached with a cable/wireline 111, the cable tension measured by a cable tension sensing device 117 and/or by a cable tension sensing device located on downhole tool string 160, and the cable speed measured by a speed sensor device 119. The conveying process is conducted by pumping a fluid from rig pump 122 (e.g., pump unit) into the upper proximal end of the casing string 112 (or 114) above the downhole tool string 160 to assist, via fluid pressure on the downhole tool string 160, movement of the downhole tool string 160 down the wellbore 150 and along inclined and horizontal sections of the wellbore 150. The pump pressure of the fluid above the downhole tool string 160 is monitored by a pressure sensing device (not shown) and the data sent to a control panel, control truck 115 for example, wherein pump unit 122 may be controlled through pump controller (not shown) as the fluid pressure changes during the conveying process and exhibit patterns indicating events such as sticking of the downhole tool string 160 in the wellbore 150. As the downhole tool string 160 is pumped (propelled) downwards by the fluid pressure that is pushing behind the downhole tool string 160, the cable 111 is spooled out at the surface by control truck 115 (e.g., winch unit) by the wellsite operator. A cable tension sensing device (not shown) may be on downhole tool string 160 to measure cable tension downhole or downhole tension measured. Another cable tension sensing device 117 may be located at surface. Either one of the cable tension sensing devices (located on downhole tool string 160 or at surface with cable tension sensing device 117) or the combination of the two cable sensing devices provides cable tension data to control the cable tension from control truck 115 through winch controller (not shown). A speed sensor device 119 located at surface provides surface cable speed data to control the cable speed from truck 115 by the wellsite operator.

Figure 2:
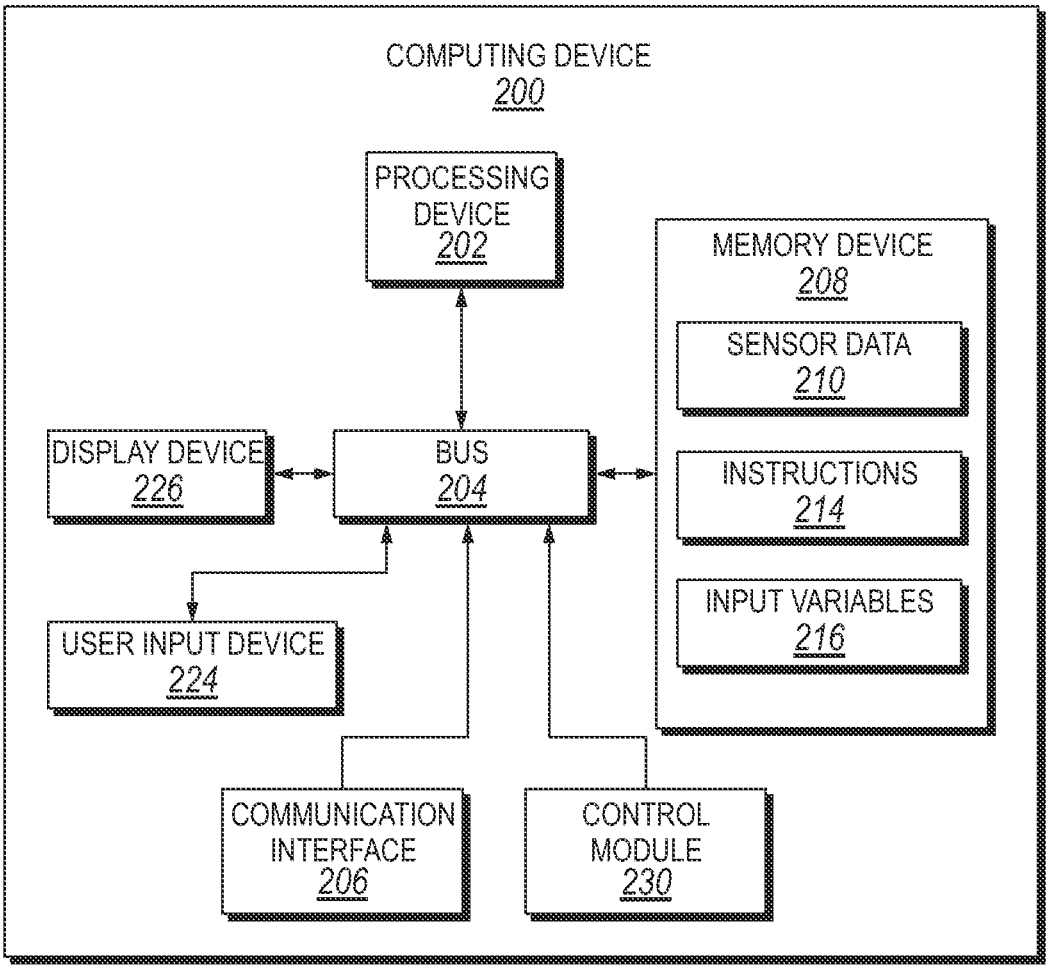
FIG. 2 illustrates a block diagram of a computing device of an automated pump-down start system, in accordance with some embodiments of the present disclosure.

In contrast, sensors and/or instrumentation related to automating operation of the system may be connected to a computing device according to some embodiments of the present disclosure (e.g., computing device 200 on FIG. 2). In various implementations, computing device 200 may be deployed in a work vehicle, such as control truck 115. Computing device 200 may be permanently installed with the system, may be hand-held, or may be remotely located. In some embodiments, computing device 200 may be distributed across two or more computers. In some examples, computing device 200 may process at least a portion of the data received and may transmit the processed or unprocessed data to a remote computing device via a wired or wireless network. Computing device 200 may be on-site, or may be off-site, such as at a data-processing center. Computing device 200 may receive the data, execute computer program instructions to analyze the data, and communicate the analysis results to computing device 200. For example, computing device 200 may communicate with a winch controller configured to control the winch unit (e.g., deployed in control truck 115) for feeding the wireline cable 111. Further, computing device 200 may communicate with a pump controller configured to control the hydraulic pump (e.g., pump unit 122).

FIG. 2 illustrates a block diagram of computing device 200 of an automated pump-down start system, in accordance with some embodiments of the present disclosure. For example, computing device 200 may include a processing device 202, a bus 204, a communication interface 206, a memory device 208, a user input device 224, a display device 226, and a control module 230. In some examples, some or all of the components shown in FIG. 2 may be integrated into a single structure, such as a single housing. In other examples, some or all of the components shown in FIG. 2 may be distributed (e.g., in separate housings or locations) and in communication with each other.

The processing device 202 can execute instructions 214 stored in the memory device 208 to perform the automated start of pump down operations. For example, processing device 202 can include one processing device or multiple processing devices. Non limiting examples of processing device 202 include a Field-Programmable Gate Array ("FPGA"), an application specific integrated circuit ("ASIC"), a micro processing device, etc.

The processing device 202 may be communicatively coupled to the memory device 208 via the bus 204. The non-volatile memory device 208 may include any type of memory device that retains stored information when powered off. Non-limiting examples of memory device 208 include electrically erasable and programmable read only memory ("EEPROM"), flash memory, or any other type of non-volatile memory. In some examples, at least some of memory device 208 may include a non-transitory medium from which the processing device 202 can read instructions. A computer-readable medium can include electronic, optical, magnetic, or other storage devices capable of providing processing device 202 with computer-readable instructions or other program code. Limiting examples of a computer-readable medium include (but are not limited to) magnetic disk (s), memory chip (s), read-only memory (ROM), random-access memory ("RAM"), an ASIC, a configured processing device, optical storage, or any other medium from which a computer processing device can read instructions. The instructions can include processing device specific instructions generated by a compiler or an interpreter from code written in any suitable computer-programming language, including, for example, C, C++, C #, etc.

In some examples, memory device 208 can include sensor data 210, (e.g., cable tension sensing device 117 (referring to FIG. 1) data, cable tension sensing device located on downhole tool string 160, speed sensor device 119 data, strain gauge data, etc.), for example. The memory device 208 can also include a database of input variables 216, such as mud weight, inclination of the wellbore, bending moment, as well as constraints such as kinematic constraints, and safety constraints. In some examples, memory device 208 can include computer program code instructions 214 for control of various aspects of the automated pump-down start system. Other collected data related to the automated pump-down start system may be stored in a log.

In some examples, computing device 200 can include a communication interface 206. Communication interface 206 can represent one or more components that facilitate a network connection or otherwise facilitate communication between electronic devices. Examples include, but are not limited to, wired interfaces such as Ethernet, USB, IEEE 1394, and/or wireless interfaces such as IEEE 802.11, Bluetooth, near-field communication (NFC) interfaces, RFID interfaces, or radio interfaces for accessing cellular telephone networks (e.g., transceiver/antenna for accessing a CDMA, GSM, UMTS, or another mobile communications network). In some examples, the computing device 200 can include a user input device 224. The user input device 224 can represent one or more components used to input data. Examples of the user input device 224 can include a keyboard, mouse, touchpad, button, or touch screen display, etc. In some examples, the computing device 200 includes a display device 226. The display device 226 can represent one or more components used to output data. Examples of display device 226 can include a liquid crystal display (LCD), a computer monitor, a touch-screen display, etc. In some examples, the user input device 224 and the display device 226 can be a single device, such as a touch-screen display.

The automated pump-down start system may include control module 230 to implement the control algorithm for automated pump-down start operation according to some aspects of the present disclosure as described in more detail below.

Figure 3:
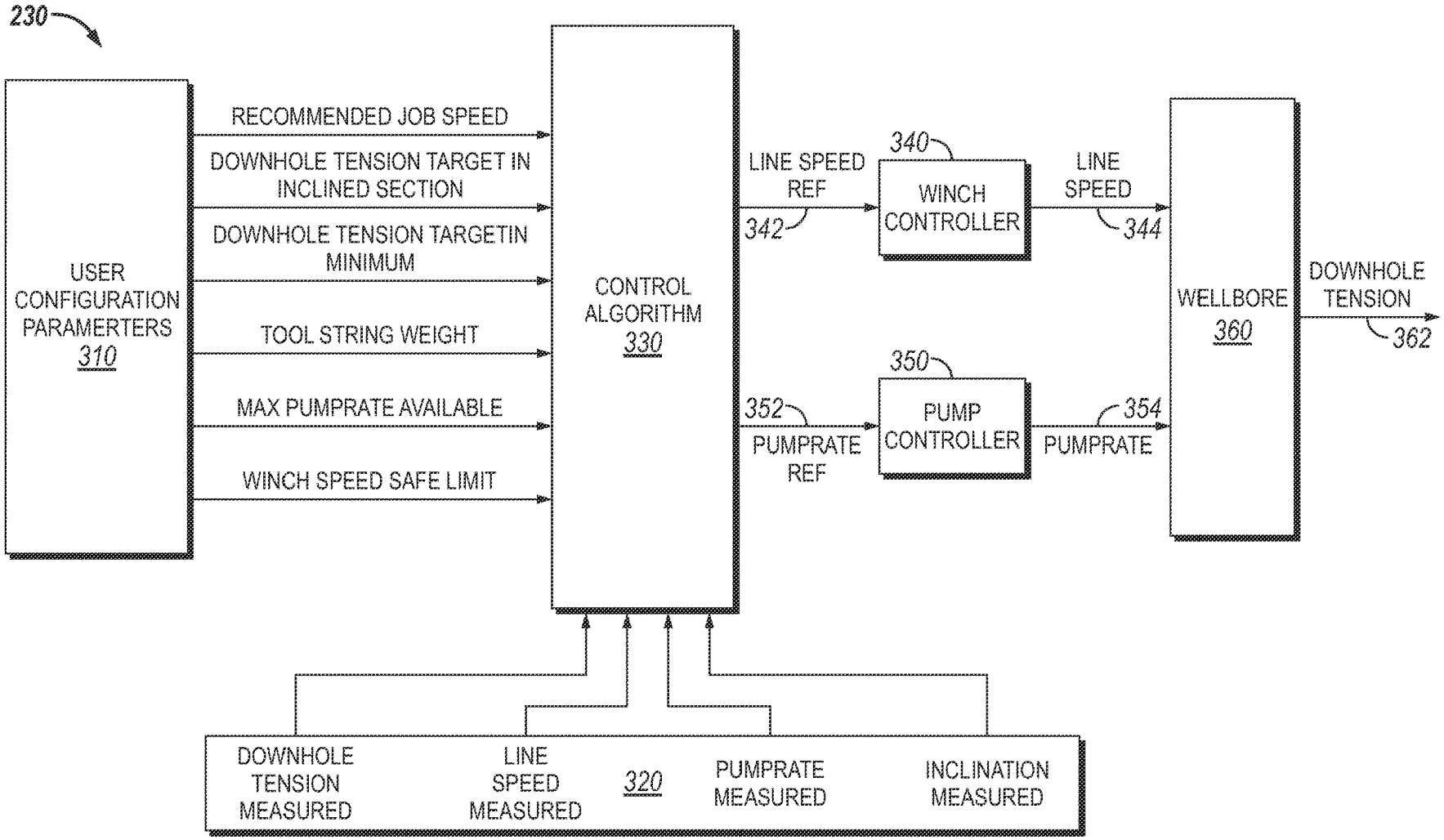
FIG. 3 is a block diagram illustrating an example of a control module for implementing a control algorithm for automated pump-down start operation according to some aspects of the present disclosure.

FIG. 3 is a block diagram illustrating an example of control module 230 for implementing a control algorithm for the automated pump-down start system according to some aspects of the present disclosure. The control module 230 may take user configuration parameters 310 and measurement parameters 320 as inputs to the control algorithm 330 and may output a line speed reference signal 342 and a pump rate reference signal 352. The user configuration parameters 310 may include a recommended job speed, a value for downhole tension target in inclined section of the wellbore, a value for minimum downhole cable tension target, downhole tool string 160 weight, maximum available pump rate, and a winch speed safe limit, among other parameters. The measurement parameters 320 may include measured downhole cable tension, measured surface cable tension, measured depth of the tool string, measured cable line speed, measured pump rate, measured speed of fluid traveling in the wellbore, measured speed of sound in wellbore fluid, measured downhole tool string inclination, and measured wellbore inclination, among others. The measured speed of fluid traveling in the wellbore may be acquired or estimated through the measurement of the speed of sound in the wellbore fluid, simulation results from fluid dynamic model, measurements from wellbore characterization test, static analysis based on the simulation results from fluid dynamic model and the measurements from wellbore characterization test, or any combination thereof.

The measurement of the speed of fluid traveling in the wellbore may include the measurement of the speed of the fluid at surface, the measurement of the speed of the fluid around downhole tool string 160, and the fluid rate delay time when the fluid pumping rate is changed at surface. For instance, a fluid rate delay time from surface to the downhole tool string may be calculated by dividing the speed of fluid traveling in the wellbore by the measured depth of the downhole tool string, wherein the downhole tool string is in contact with the wellbore fluid. The speed of fluid traveling in the wellbore may be measured by any sensor capable of measuring the speed of a fluid including any sensor capable of measuring the speed of the fluid in contact with the sensor located on the downhole tool string or any sensor capable of measuring the speed of the fluid in contact with the sensor located at surface corrected by a fluid rate delay time. The sensor may be any flow meter or pressure sensor installed on downhole tool string 160 or at surface or at both locations. The calculation for the delay time may rely on the signature of the sensor location at surface and the same signature located on the downhole tool string. The signature includes the frequency of the signal, the amplitude of the signal, or any combination thereof. Having a sensor capable of measuring in real time the speed of fluid on the downhole tool string and another sensor capable of measuring in real time the speed of fluid at surface allows to estimate the delay time between the change of speed of the fluid at surface when the pump rate is varied and the change of the speed of fluid on the downhole tool string. The delay time may be calculated based on a pressure sensor at surface and another pressure sensor on the downhole tool string, for example. The delay time between the change of pump rate at surface and the change of the speed of the fluid around the downhole tool string may be calculated based on a flow meter located at surface and another flow meter located on the downhole tool string, for example. The delay time may be calculated based on any combination of sensors located at surface and at least another sensor located on downhole tool string, wherein the at least two sensors may be the same type of sensors or different type of sensors.

The configuration parameters 310 and measurement parameters 320 may be input to the control algorithm 330. The control algorithm 330 may output the line speed reference signal 342 to a winch controller 340, and the pump rate reference signal 352 to a pump controller 350. The winch controller 340 and the pump controller 350 may generate line speed command 344 and a pump rate command 354, respectively, to control the downhole tension 362 of the wireline cable 111 in wellbore 150 (referring to FIG. 1).

The automated pump-down start system is configured to receive user configuration parameters 310 and measurement parameters 320 (e.g., inclination measured and system parameters), determine whether downhole tool string 160 (referring to FIG. 1) is at a transition from a vertical section to a lateral or horizontal section of wellbore 150, and adjust pump fluid rate 354 and winch line speed 344 accordingly by sending respective commands to pump unit 122 (referring to FIG. 1) and winch unit (e.g., deployed in control truck 115) through pump controller 350 and winch controller 340, respectively. The determination of the position of downhole tool string 160 in wellbore 150 may be calculated based on the measured depth and the well survey acquired from a different wellbore operation than the pump down operation, for example. In some embodiments, the user may input in the configuration parameters 310 the well survey including the inclination as a function of depth, for example. As the wellbore inclination is known as a function of depth, the inclination of downhole tool string 160 can be calculated based on the measurement of downhole tool string 160 depth assuming downhole tool string 160 as the same inclination as wellbore 150 at the same depth. Therefore, the automated pump-down start system is configured to detect a transition section (e.g., a rapid trajectory changes in the wellbore) in wellbore 150 through measurement parameters 320 (e.g., measured inclination) from downhole tool string 160, determine if the measured inclination from measurement parameters 320 is within a specific range stored in user configuration parameters 310, and accurately and reliably maintain wireline tension in a desired range while avoiding slowing or stopping the winch unit by adjusting pump fluid rate 354 and winch line speed 344 accordingly by sending respective commands to pump unit 122 (referring to FIG. 1) and winch unit (e.g., deployed in control truck 115) through pump controller 350 and winch controller 340, respectively. The received inputs from user configuration parameters 310 and measurement parameters 320 may include the measured downhole cable tension through the cable tension sensing device located on downhole tool string 160 (referring to FIG. 1), the measured surface cable tension through cable tension sensing device 117 located at surface, the measured cable line speed through speed sensor device 119 or through a speed sensor device located on downhole tool string 160, the measured fluid pump rate of pump unit 122, the measured inclination of downhole tool string 160 through a sensor measuring inclination on downhole tool string 160 such as a gyroscope, for example, or via off-line survey synchronized with the measured depth of downhole tool string 160, the measured depth of downhole tool string 160, measured speed of fluid traveling in the wellbore, measured speed of sound in wellbore fluid, the recommended job speed, the downhole cable tension target in inclined section, downhole cable tension target in inclined section, the minimum downhole cable tension target, the tool string weight, the maximum pump rate available from pump unit 122, and the winch speed safe limit for winch unit (e.g., deployed in control truck 115). For example, the automated pump-down system may determine that downhole tool string 160 is in the transition phase in response to determining that the inclination input is between thirty degrees and sixty degrees.

Moreover, in the transition phase, downhole tool string 160 may start to lean on the casing of wellbore 150 more than in the vertical section. As such, the casing may at least partially counteract the gravity driving downhole tool string 160 such that the wireline tension may reduce as the inclination increases.

Figure 4:
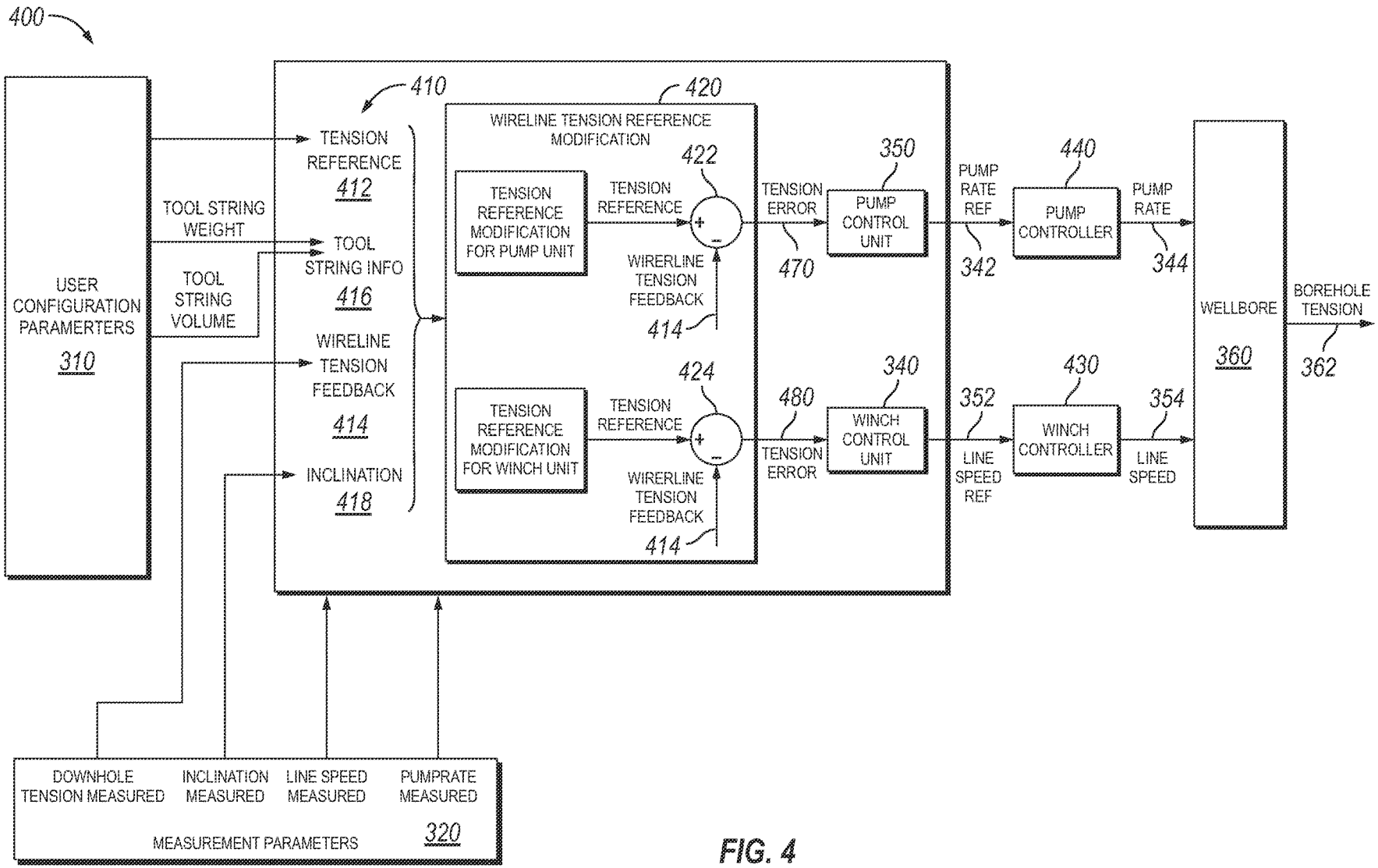
FIG. 4 illustrates a system diagram of an automated pump-down start system, in accordance with some embodiments of the present disclosure.

FIG. 4 illustrates a system diagram 400 of an automated pump-down start system, in accordance with some embodiments of the present disclosure. The automated pump-down start system is configured to process user configuration parameters 310 (referring to FIG. 3) and measurements parameters 320 as input 410 to provide an automated adjustment of the cable tension of downhole tool string 160 as wireline tension reference modification 420 through pump control unit 430 and winch control unit 440. The user configuration parameters 310 include the wireline tension reference 412, downhole tool string 160 weight, downhole tool string 160 volume, and other downhole tool string information 416, for example. The measurement parameters 320 include the measured downhole tension of the wireline or cable, the wireline tension feedback 414, and the measured inclination 418 of downhole tool string 160, for example. The user configuration parameters 310 and the measurement parameters 320 will feed control algorithm 330 (referring to FIG. 3), which will output two ranges of wireline tension references. The two ranges of wireline tension references include one range of tension reference for pump unit 122 and one range of tension reference for winch unit (e.g., deployed in control truck 115). If control algorithm 330 receives an input that triggers a need for correction of the wireline tension, control algorithm 330 will output wireline tension reference modification 420. The input may be at least one of the measurement parameters 320 and/or at least one of the configuration parameters 320. In some embodiments, the wireline tension reference modification may be sent to pump unit 122 alone or to winch unit (e.g., deployed in control truck 115) alone, or any combination thereof. Having two different ranges of wireline tension references for pump unit 122 alone and for the winch unit (e.g., deployed in control truck 115) alone gives the capability to the automated pump-down start system 400 for a more precise control of the pump-down start operation.

The automated pump-down start system 400 is configured to output a tension error signal 470 for pump controller 350, which controls pump unit 122 through the pump control unit 430 to adjust the pump rate 354 to a pump rate reference 352 when the wireline tension feedback 414 is outside the range of wireline tension reference 422 for pump unit 122, for example. The automated pump-down start system 400 is configured to output a winch unit tension error signal 480 for winch controller 340, which controls the winch unit line speed 344 to a wireline speed reference 342 through the winch control unit 440 when the wireline tension feedback 414 is outside the range of wireline tension reference 424 for winch unit (e.g., deployed in control truck 115), for example. The winch unit tension error signal 480 may be based at least in part on received inputs such as a target winch cable tension reference 424, winch cable or wireline tension feedback 414 from cable tension sensing device 117 (referring to FIG. 1) and/or from cable tension sensing device located on downhole tool string 160, tool string information 416, and the measured inclination 418 of downhole tool string 160 through a sensor measuring inclination on downhole tool string 160 such as a gyroscope, or the inclination can be obtained via offline survey synchronized with the measured depth of downhole tool string 160, for example. These inputs may be specific values, ranges of values, etc. that are provided via direct measurements, statistics, simulations, calculations, or any other suitable source. The automated pump-down start system 400 may maintain wireline or cable tension in a desired range such as pump target cable tension reference 422 by adjusting the pump fluid rate 354 via pump control unit 430 based on pump wireline tension feedback 414 measured by cable tension sensing device 117 (referring to FIG. 1) and/or from cable tension sensing device located on downhole tool string 160. The automated pump-down start system 400 may maintain wireline or cable tension in a desired range such as winch target cable tension reference 424 by adjusting winch line speed 460 via winch control unit 440 based on winch wireline tension feedback 424 measured by cable tension sensing device 117 (referring to FIG. 1) and/or from cable tension sensing device located on downhole tool string 160. As set forth in greater detail below, pump control unit 430 may have a positive correlation with its input (e.g., pump unit tension error signal 470), such that if the tension error is positive then pump fluid rate 450 output increases and vice versa. However, winch control unit 440 may have a negative correlation with its input (e.g., winch tension error signal 480), such that if the tension error is positive then winch line speed 344 output should decrease and vice versa.

Moreover, automated pump-down start operations may begin with downhole tool string 160 disposed within the vertical section of wellbore 150. In the vertical section, gravity may drive movement of downhole tool string 160 independent of pump unit 122. That is, pump fluid rate 354 output via pump unit 122 may not be required to advance downhole tool string 160 in the vertical section. As such, the automated pump-down start system 400 may hold pump fluid rate 354 at about zero in the vertical section. Further, the automated pump-down start system may hold winch line speed 460 at a particular winch line speed 344 for lowering downhole tool string 160 in the vertical section. Additionally, in the vertical section, the automated pump-down start system 400 may set winch tension error signal 480 to zero. Indeed, the automated pump-down start system may calibrate winch tension error signal 480 in the vertical section. With a zero-tension error, the automated pump-down start system 400 may be configured to maintain current output pump fluid rate 450 and winch line speed 460. In the vertical section, the zero-tension error 470 and 480 may result in the system keeping the current winch line speed 344 on winch control unit 440 and instructing pump control unit 430 to maintain the pump fluid rate 354 at about zero.

As downhole tool string 160 travels further into wellbore 150, downhole tool string 160 may pass through a curved portion or transition of wellbore 150. At the transition from a vertical section to a lateral or horizontal section of wellbore 150, the wellbore deviation may increase, and the inclination may rise. The automated pump-down start system may determine that downhole tool string 160 is in the transition based at least in part on determining that measured inclination 418 is within a certain range. For example, the automated pump-down start system 400 may determine that downhole tool string 160 is in the transition phase in response to determining that measured inclination 418 is between thirty degrees and sixty degrees. Moreover, in the transition phase, downhole tool string 160 may start to lean on the casing of the wellbore more than in the vertical section. As such, downhole tool string 160 casing may at least partially counteract the gravity driving downhole tool string 160 such that cable or wireline tension feedback 414 from cable tension sensing device 117 (referring to FIG. 1)

and/or from cable tension sensing device located on downhole tool string 160 may reduce as the inclination increases.

Further, in response to the change of inclination in wellbore 150, the automated pump-down start system may be configured to adjust the wireline tension reference 412 set forth below. The wireline tension reference 412 for pump unit 122 may be based at least in part on the desired wireline tension reference for the pump-down operation in horizontal section and the wireline tension when the tool string is in the vertical section of wellbore 150 (e.g., hanging in the wellbore). For example, in the physical model approach, the wireline tension reference at downhole side ($T_{pump}$) when downhole tool string 160 is moving in constant speed may be equal to:

$$T_{pump} = \max((W - \rho Vg) \times \cos\theta, T_{desired}) \quad \text{Equation (1)}$$

In Equation (1) above, $T_{pump}$ is the wireline tension reference at downhole side for the pump unit, W is the tool string weight, ρ is the density of the fluid in the wellbore, V is the volume of the downhole tool string, g is the gravity constant, and θ is the inclination in degrees. Based on Equation (1) above, the wireline tension in the vertical section is the tool weight less the buoyancy force. As the inclination in degree increases from 0°, the wireline tension reference at downhole side 412 decreases. As the inclination in degree increases close to 90°, the wireline tension caused by downhole tool string 160 weight reduces close to zero. Accordingly, wireline tension reference at downhole side 412 may be limited to the value of desired wireline tension reference at downhole side in the horizontal section. When downhole tool string 160 reaches high degree of inclination, gravity may not provide sufficient driving force on downhole tool string 160 to maintain the wireline tension and downhole tool string 160 may not move forward along wellbore 150 without fluid being pumped into wellbore 150, via pump unit 122 controlled by pump control unit 430, providing a driving force on downhole tool string 160.

Accordingly, the automated pump-down start system 400 may instruct pump unit 122 through pump control unit 430 to increase pump fluid rate 354 into wellbore 150 based at least on determined pump unit tension error signal 470. That is, the automated pump-down start system 400 may compare the wireline tension reference at downhole side 412 ($T_{pump}$ in Equation (1) above) to the measured cable or wireline tension feedback 414 from cable tension sensing device located on downhole tool string 160 and generates pump unit tension error signal 470 to pump control unit 430 that will direct pump unit 122 to adjust pump fluid rate 354 accordingly. Generally, it is expected for the pump unit tension error signal 470 to increase while downhole tool string 160 is getting closer to the horizontal section of the wellbore, or equivalently closer to 90° of the inclination degree. As such, the increase of the pump unit tension error signal 470 may cause pump unit 122 to increase pump fluid rate 450.

However, the wireline tension reference at downhole side 424 for winch unit (e.g., deployed in control truck 115) may be adjusted differently than the wireline tension reference 422 for pump unit 122. As set forth below, wireline tension reference at downhole side for winch unit 424 may be equal to the measured wireline tension within a certain range 414. For example, the wireline tension reference at downhole side for winch unit ($T_{winch}$) 424 may be:

$$T_{winch} = \begin{cases} (W - \rho Vg) \times \cos\theta; (W - \rho Vg) \times \cos\theta \le Tmeas \\ T_{meas}, [(W - \rho Vg) \times \cos\theta \ge Tmeas \ge T_{desired}] \\ T_{deisred}, Tmeas \le T_{desired} \end{cases} \quad \text{Equation (2)}$$

In Equation (2) above, $T_{winch}$ is the wireline tension reference at downhole side for the winch unit, W is the tool string weight, ρ is the density of the fluid in the wellbore, g is the gravity constant, and θ is the inclination in degrees. Equation (2) indicates that the wireline tension reference at downhole side for winch unit ($T_{winch}$) is equal to the measured wireline tension ($T_{meas}$) if the measured wireline tension is less than, or equal to, the wireline tension created by the gravity and greater than, or equal to, the desired wireline tension reference for horizontal section ($T_{desired}$). In one example, the tool string may be driven by gravity, which may result in the tension error being zero for the winch unit. As such, the winch unit may maintain the current line speed as line speed adjustments may not be necessary to allow the tool string to continue to move forward along the wellbore.

In another example, the measured cable or wireline tension feedback 414 from cable tension sensing device located on downhole tool string 160 could be higher than the wireline tension created by the gravity of downhole tool string 160. This may be the result of unexpected changes in the wellbore geometry. In this example, the increase of the wireline tension 414 could exceed the maximum allowed wireline tension threshold. Thus, winch tension error signal 480 may be emitted to winch control unit 440 to increase winch line speed 460 through winch unit (e.g., deployed in control truck 115) to avoid damage of downhole tool string 160 or the cable/wireline. According to the equation set forth above, the wireline tension reference for the winch unit 424 may be limited to the wireline tension created by the gravity and the wireline tension error may be a negative value. As winch control unit 440 may have a negative correlation as set forth above, winch control unit 440 may be configured to increase winch line speed 460 to reduce the wireline tension.

In another example, the measured cable or wireline tension feedback 414 from cable tension sensing device located on downhole tool string 160 could be lower than the desired wireline tension reference of the horizontal section. This may be the result of an insufficient pump rate when downhole tool string 160 lands on the horizontal section. In response, the automated pump-down start system may instruct winch control unit 440 through winch tension error signal 480 for winch unit (e.g., deployed in control truck 115) to reduce winch line speed 460 so that the wireline can maintain a desired tension. According to Equation (2) set forth above, the wireline tension reference for winch unit 424 may be limited to the desired wireline tension of the horizontal section, such that the wireline tension error signal 480 has a positive value in this example. As the winch control unit 440 may have a negative correlation as set forth above, the winch control unit 440 may reduce the winch line speed 460 to increase the wireline tension.

After downhole tool string 160 passes through the curved portion, transition, or deviation portion of wellbore 150, downhole tool string 160 may land on the horizontal section of the wellbore. At the horizontal section of wellbore 150, the inclination may be close to ninety degrees. The automated pump-down start system may determine that downhole tool string 160 is positioned in the horizontal section in response to the measured inclination 418 being greater than certain threshold value. For example, the automated pump-down start system may determine that downhole tool string 160 is positioned in the horizontal section in response to the measured inclination 418 being greater than eighty-five degrees. In the horizontal section, the wireline tension reference 424 may retain the desired wireline tension reference of the horizontal section and the pump control unit 430 and winch control unit 440 may maintain this wireline tension reference of the horizontal section. Moreover, in the horizontal section, the automated pump-down start system may be configured to slow and/or stop downhole tool string 160 at a target location in the wellbore.

As set forth above, the automated pump-down start system and associated method are configured to automate pump-down start operations through curved sections of wellbore 150 with severe trajectory changes (e.g., doglegs). In response to downhole tool string 160 reaching a dogleg, downhole tool string 160 may land on the casing even when the deviation of wellbore 150 is low. As such, downhole tool string 160 may start to have difficulty advancing with gravity only. Thus, the automated pump-down start system may increase pump fluid rate 450 via pump control unit 430 to continue to drive downhole tool string 160. For example, with the physical model approach described in Equation 1, the wireline tension without pump rate can be much less than the estimation of Equation 1 in the dogleg condition. In this example, the pump unit tension error signal 470 becomes larger than normal. As such, the increase of pump unit tension error signal 470 may trigger an adjustment of pump control unit 430 to increase pump fluid rate 450, which may help to advance downhole tool string 160 along wellbore 150.

In another example, the automated pump-down start system and associated method may change the wireline tension feedback for winch unit 414 during curved wellbore as shown in Equation 2 above. Thus, the winch tension error signal 480 may remain zero, even though the dogleg causes the wireline tension feedback for winch unit 414 to decrease dramatically. If the wireline tension feedback for winch unit 414 fails to drop below the wireline tension reference for winch unit 424 for horizontal section but if the wireline tension is still sufficient to maintain the wireline tight, winch control unit 430 may let winch unit (e.g., deployed in control truck 115) maintain its current winch line speed 460 and let downhole tool string 160 moving. This may be advantageous compared to traditional systems that adjust the winch line speed 460 to keep the wireline tension feedback for winch unit 414 tight to the reference. In this example, the increase of winch tension error signal 480 can potentially slow down or stop the winch unit (e.g., deployed in control truck 115) while pump control unit 430 signals pump unit 122 to increase pump fluid rate 354, which may lead to failure of the pump-down operation.

The automated pump-down start system 400 may be configured to control pump unit 122 (referring to FIG. 1) through pump control unit 430 (referring to FIG. 4) and winch unit (e.g., deployed in control truck 115) through winch control unit 440 without information regarding well geometry and/or tool details. As such, wireline tension reference 422 for pump unit 122 and wireline tension reference 424 for winch unit may not be modified based on such information. Thus, in the vertical or deviated sections of wellbore 150, the actual line tension could be much higher than the reference due to downhole tool string 160 weight. Generally, the automated pump-down start system may increase winch line speed 460 to full speed and keep pump fluid rate 450 low. The wireline tension feedback 414 may start to reduce in response to downhole tool string 160 approaching the horizontal section. In response to the reduced wireline tension 414, the automated pump-down system may instruct pump unit 122 to output a higher pump fluid rate 354 to maintain wireline tension 414. However, due to the response time limit, the pump fluid rate 354 may not increase fast enough to prevent downhole tool string 160 from stopping in wellbore 150.

Figure 5:
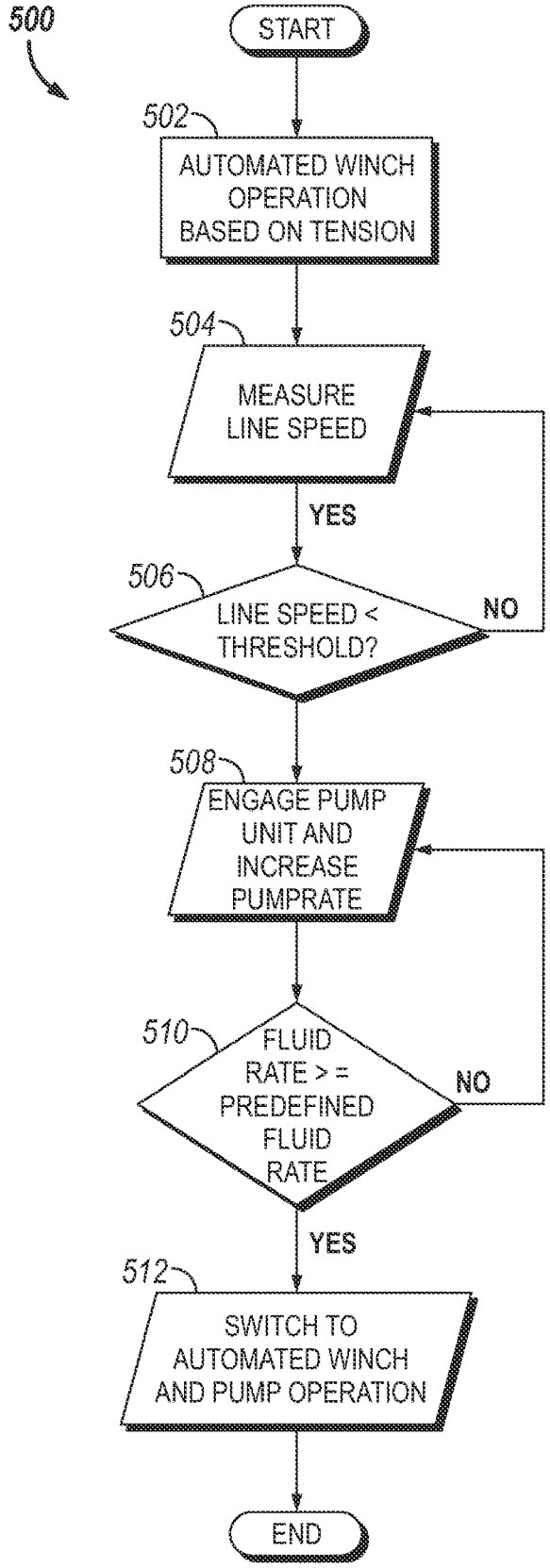
FIG. 5 illustrates a flow diagram of a method for automating a pump-down start operation at a transition from a vertical section to a lateral or horizontal section of a wellbore, in accordance with some embodiments of the present disclosure.

FIG. 5 illustrates a flow diagram 500 of a method for automating a pump-down start operation at a transition from a vertical section to a lateral or horizontal section of wellbore 150 (referring to FIG. 1), in accordance with some embodiments of the present disclosure. In step 502, the automated pump-down start system may be configured to automate winch operation based on winch wireline tension reference 424 (referring to FIG. 4) and winch wireline tension feedback 414 measured by cable tension sensing device located on downhole tool string 160, for example. In step 504, the cable line speed is measured through speed sensor device 119, for example. In step 506, the automated pump-down start system determines if the measured cable line speed is equal to or above a reference threshold. If the cable line speed is above the reference threshold, the automated pump-down start system continues to automate winch operation based on winch wireline tension reference 424 and winch wireline tension feedback 414 measured by cable tension sensing device 117 and/or by cable tension sensing device located on downhole tool string 160, for example. If the cable line speed measured by cable tension sensing device located on downhole tool string 160 is below the reference threshold, the automated pump-down start system moves to step 508 and engages pump unit 122 through pump control unit 430 to increase pump fluid rate 450 (reference to FIG. 4). Then, in step 510, the automated pump-down start system determines if the pump fluid rate 450 is equal to or above a predefined pump fluid rate. If it is not, the automated pump-down start system continues to engage pump fluid unit 122 and increase pump fluid rate 450. However, if pump fluid rate 450 is equal to or above a predefined pump fluid rate, the automated pump-down start system moves to step 512 and switch to automated winch and pump operation described above. Accordingly, the automated pump-down start system may switch to normal automated pump-down start operation where both winch unit and pump unit are regulated based on-line tension. Moreover, the predefined line speed and predefined fluid rate value may be based at least in part on user input.

Accordingly, the present disclosure may provide systems and methods for automating a pump-down start operation and, more particularly, example embodiments may include an automated pump-down start system that adjusts a pump fluid rate and a winch speed at a transition from a vertical section to a lateral or horizontal section of a wellbore.

Statement 1. A method for automating a start of a pump-down operation comprising: lowering a downhole tool string into a wellbore via a wireline controlled by a winch unit and a pump unit; measuring at least one measurement parameter calculating a range of wireline tension references for the winch unit from at least inputs comprising at least one user configuration parameter and the at least one measurement parameter; calculating a range of wireline tension references for the pump unit from at least inputs comprising at least one user configuration parameter and the at least one measurement parameter; generating a tension error signal for the winch unit when a measured tension of the wireline deviates from the calculated range of wireline tension references for the winch unit; generating a tension error signal for the pump unit when a measured tension of the wireline deviates from the calculated range of wireline tension references for the pump unit; and adjusting the lowering of the downhole tool string in response to the tension error signal for the winch unit and/or the tension error signal for the pump unit.

Statement 2. The method of Statement 1, wherein calculating the range of wireline tension references for the winch unit comprises calculating a target range of wireline tension reference for the winch unit for a horizontal section and calculating a target range of wireline tension reference for the winch unit for a curved section.

Statement 3. The method of Statement 1 or Statement 2, wherein calculating the range of wireline tension references for the pump unit comprises calculating a target wireline tension reference for the pump unit for a horizontal section and calculating a net weight of the downhole tool located at a curved section without pumping fluid and selecting the largest value of the two calculations as the upper range of the wireline tension reference for the pump unit.

Statement 4. The method of any of Statements 1 to 3, wherein the measured tension of the wireline is above the calculated upper range of the wireline tension references for the winch unit for the curved section, and wherein adjusting the lowering of the downhole tool string in response to the tension error signal comprises instructing a winch unit to increase a line speed.

Statement 5. The method of any of Statements 1 to 4, wherein the measured tension of the wireline is below the calculated lower range of wireline tension reference for the winch unit for the curved section, and wherein adjusting the lowering of the downhole tool string in response to the tension error signal comprises instructing a winch unit to reduce a line speed.

Statement 6. The method of any of Statements 1 to 5, wherein calculating a range of wireline tension references for the winch unit comprises calculating a range of wireline tension references for the winch unit with the upper range being based at least on one measurement parameter with the downhole tool string located at a curved section and the lower range being based at least on one measurement parameter with the downhole tool string located in a horizontal section.

Statement 7. The method of any of Statements 1 to 6, further instructing the winch unit to maintain a line speed when the measured tension of the wireline is within the calculated range of wireline tension references for the winch unit.

Statement 8. The method of any of Statements 1 to 7, wherein calculating a range of wireline tension references for the pump unit comprises calculating a target wireline tension reference for the pump unit with the downhole tool string located at a curved section.

Statement 9. The method of any of Statements 1 to 8, further instructing the pump unit to increase a pump rate when the measured tension of the wireline is below the desired wireline tension reference for the pump unit with the downhole tool string located at a curved section.

Statement 10. The method of any of Statements 1 to 9, further instructing the pump unit to reduce a pump rate when the measured tension of the wireline is above the calculated upper range of the wireline tension references for the pump unit with the downhole tool string located at a curved section.

Statement 11. The method of any of Statements 1 to 10, wherein the at least one user configuration parameter comprises at least one user configuration parameter selected from the group consisting of a tension reference, a downhole tool string weight, a downhole tool string volume, and any combination thereof.

Statement 12. The method of any of Statements 1 to 11, wherein the at least one measurement parameter comprise at least one measurement parameter selected from the group consisting of a downhole tension of the wireline, an inclination of the downhole tool string, and any combination thereof.

Statement 13. The method of any of Statements 1 to 12, wherein the calculated range of the wireline tension references for the pump unit comprises a wireline tension reference for the pump unit ($T_{pump}$) when the downhole tool string is moving at constant speed equal to:

$$T_{pump} = \max((W - \rho Vg) \times \cos\theta, T_{desired})$$

wherein W is the tool string weight, ρ is the density of the fluid in the wellbore, V is the volume of the downhole tool string, g is the gravity constant, and θ is the inclination in degrees.

Statement 14. The method of any of Statements 1 to 13, wherein the calculated range of wireline tension references for the winch unit comprises a wireline tension reference at downhole side for the winch unit ($T_{winch}$) equal to:

$$T_{winch} = \begin{cases} (W - \rho Vg) \times \cos\theta; (W - \rho Vg) \times \cos\theta \leq Tmeas \\ T_{meas}, [(W - \rho Vg) \times \cos\theta \geq Tmeas \geq T_{desired}] \\ T_{deisred}, Tmeas \leq T_{desired} \end{cases}$$

wherein W is the tool string weight, ρ is the density of the fluid in the wellbore, g is the gravity constant, V is the volume of the downhole tool string, θ is the inclination in degrees, $T_{meas}$ is the measured wireline tension, and $T_{desired}$ is the desired wireline tension reference for horizontal section.

Statement 15. A method for automating a start of a pump-down operation: lowering a downhole tool string into a wellbore via a wireline controlled by a winch unit and a pump unit; measuring at least three measurement parameters, wherein the measurement parameters comprise a measured wireline tension, a measured pumping rate, and a measured line speed of the wireline; calculating a range of wireline tension references for the winch unit from at least inputs comprising at least one user configuration parameter and the at least three measurement parameters; calculating a range of wireline tension references for the pump unit from at least inputs comprising at least one user configuration parameter and the at least three measurement parameters; comparing the measured wireline tension to the calculated range of wireline tension references for the winch unit; comparing the measured wireline tension to the calculated range of wireline tension references for the pump unit; generating a tension error signal for the winch unit when the measured wireline tension deviates from the calculated range of wireline tension references for the winch unit; generating a tension error signal for the pump unit when a measured wireline tension deviates from the calculated range of wireline tension references for the pump unit; and adjusting the lowering of the downhole tool string in response to the tension error signal for the winch unit and/or the tension error signal for the pump unit.

Statement 16. The method of Statement 15, wherein generating the tension error signal is performed by a winch controller acting as a feedback controller generating a line speed command based on the calculated range of wireline tension references for the winch unit and the measured wireline tension.

Statement 17. The method of Statement 15 or Statement 16, wherein generating the tension error signal is performed by a pump controller acting as a feedback controller generating a pump rate command based on the calculated range of wireline tension references for the pump unit and the measured wireline tension.

Statement 18. The method of any of Statements 15-17, wherein the calculated range of the wireline tension references for the pump unit comprises a wireline tension reference for the pump unit ($T_{pump}$) when the downhole tool string is moving at constant speed equal to:

$$T_{pump} = \max((W - \rho Vg) \times \cos\theta, T_{desired})$$

wherein W is the tool string weight, ρ is the density of the fluid in the wellbore, V is the volume of the downhole tool string, g is the gravity constant, and θ is the inclination in degrees.

Statement 19. The method of any of Statements 15-18, wherein the calculated range of wireline tension references for the winch unit comprises a wireline tension reference at downhole side for the winch unit ($T_{winch}$) equal to:

$$T_{winch} = \begin{cases} (W - \rho Vg) \times \cos\theta; (W - \rho Vg) \times \cos\theta \leq Tmeas \\ T_{meas}, [(W - \rho Vg) \times \cos\theta \geq Tmeas \geq T_{desired}] \\ T_{deisred}, Tmeas \leq T_{desired} \end{cases}$$

wherein W is the tool string weight, ρ is the density of the fluid in the wellbore, g is the gravity constant, V is the volume of the downhole tool string, θ is the inclination in degrees, $T_{meas}$ is the measured wireline tension, and $T_{desired}$ is the desired wireline tension reference for horizontal section.

Statement 20. The method of any of Statements 15-19, wherein the at least one user configuration parameter comprises at least one user configuration parameter selected from the group consisting of a range of wireline tension references for the pump unit, a range of wireline tension references for the winch unit, a downhole tool string weight, a downhole tool string volume, and any combination thereof.

To facilitate a better understanding of the present invention, the following examples of certain aspects of some embodiments are given. In no way should the following examples be read to limit, or define, the entire scope of the disclosure.

EXAMPLES

Different use case scenarios were simulated to evaluate the performance of some embodiments for automating a pump down stop operation.

Figure 6:
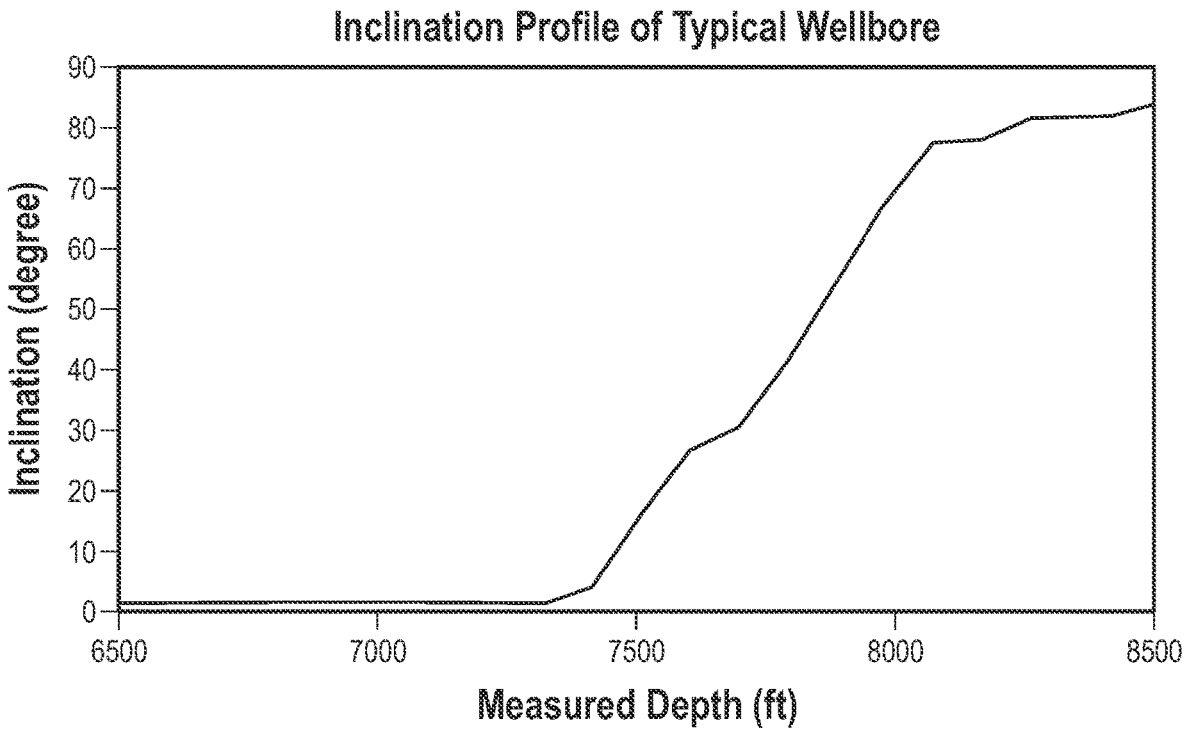
FIG. 6 shows a survey of a wellbore used for a set of simulations according to some embodiments of the present disclosure through the inclination of the wellbore plotted as a function of the measured depth in feet (ft).

FIG. 6 shows a survey of a wellbore used for a set of simulations according to some embodiments of the present disclosure through the inclination of the wellbore plotted as a function of the measured depth in feet (ft). The inclination is constant around 0 degrees the first 7,250 ft (2,214 m) before going to around 85 degrees from 7,250 ft (2,214 m) to 8,500 ft (2,596 m) to simulate a wellbore having a vertical section from surface to around 7,250 ft (2,214 m) followed by a highly deviated section from around 8,000 ft (2,443 m). The changes from the vertical section to a highly deviated section from 7,250 ft (2,214 m) to 8,250 ft (2,596 m) can be problematic for a pump down operation where coordination between the pump unit and the winch unit is paramount for a successful and efficient operation. Before the start of the pump down operation, the downhole tool string 160 is lowered at a speed of 350 feet per minute (fpm) in the vertical section. There is no fluid rate generated by pump unit 122 in this section.

Figure 7A:
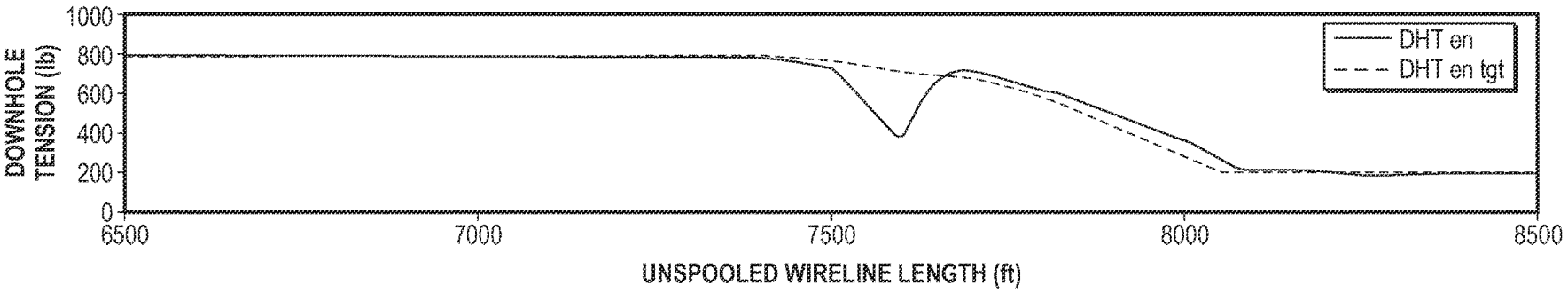
FIGS. 7*a*-7*c* show an example of a simulation of an automated start of a pump down operation with a common downhole wireline tension target for both winch unit and pump unit.
Figure 7B:
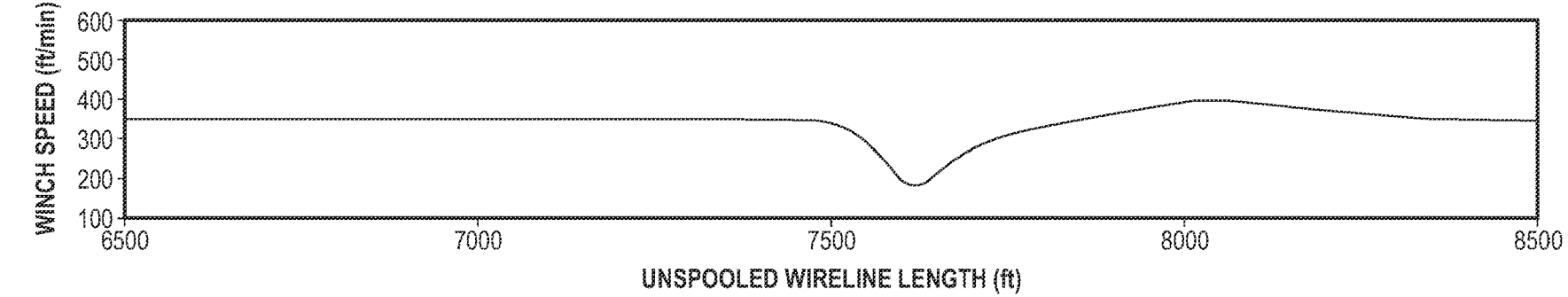
Figure 7C:
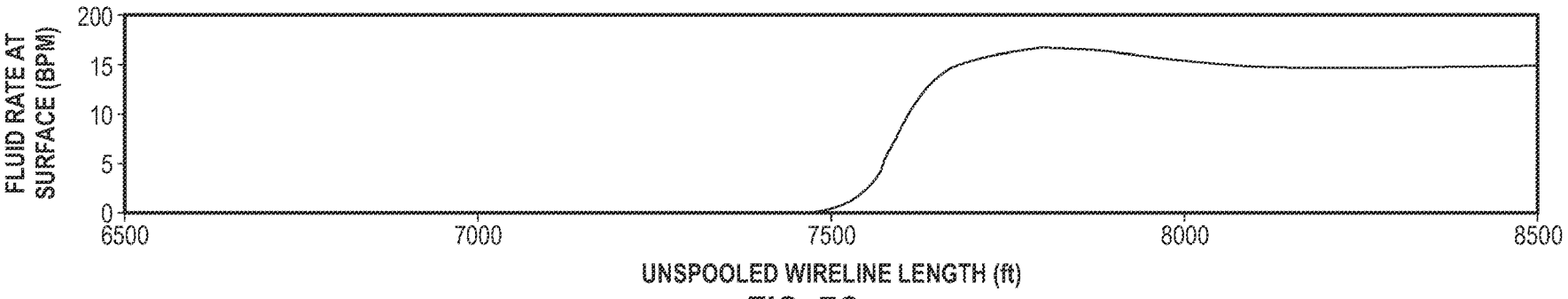

FIGS. 7*a*-7*c* show an example of a simulation of an automated start of a pump down operation with a common downhole wireline tension target for both winch unit and pump unit. As downhole tool string 160 approaches the highly deviated section, the lower end of downhole tool string 160 can touch the casing and some of its weight can be supported by the casing. This is simulated by gradually subtracting a 300 lb (136 kg) downhole tension offset as shown in the continuous line in FIG. 7*a*. When a common single value downhole wireline tension target (dotted line in FIG. 7*a*) is assigned to both the winch unit and pump unit 122, the algorithm addresses the downhole tension offset when the downhole tension measured is different than the common downhole tension target by sending a downhole tension error signal to slow down the winch unit aggressively as shown in FIG. 7*b* and to slow down the pump rate aggressively as shown in FIG. 7*c*.

Figure 8A:
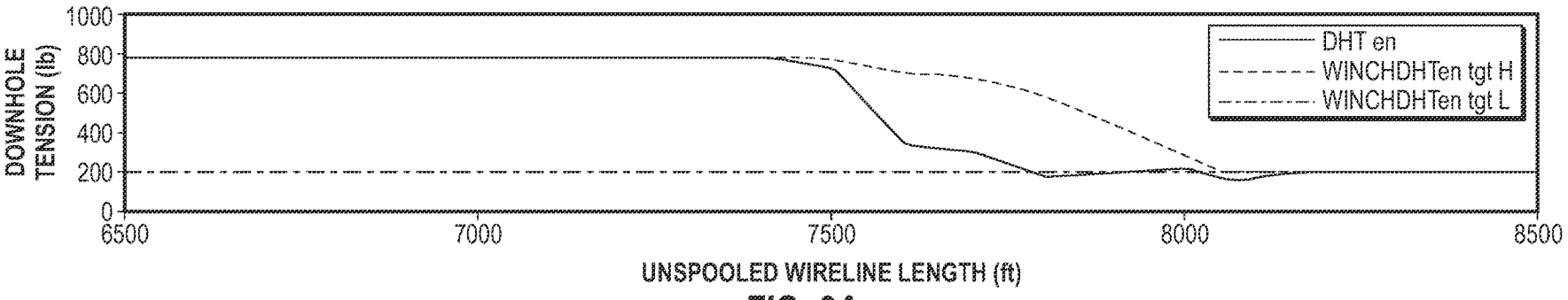
FIGS. 8*a*-8*c* show an example of an automated start of a pump down operation according to embodiments of the present disclosure.
Figure 8B:
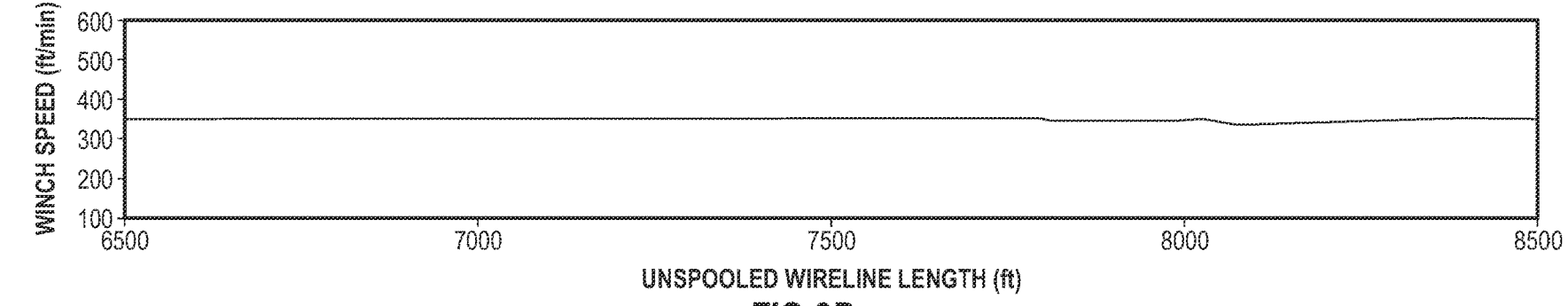
Figure 8C:
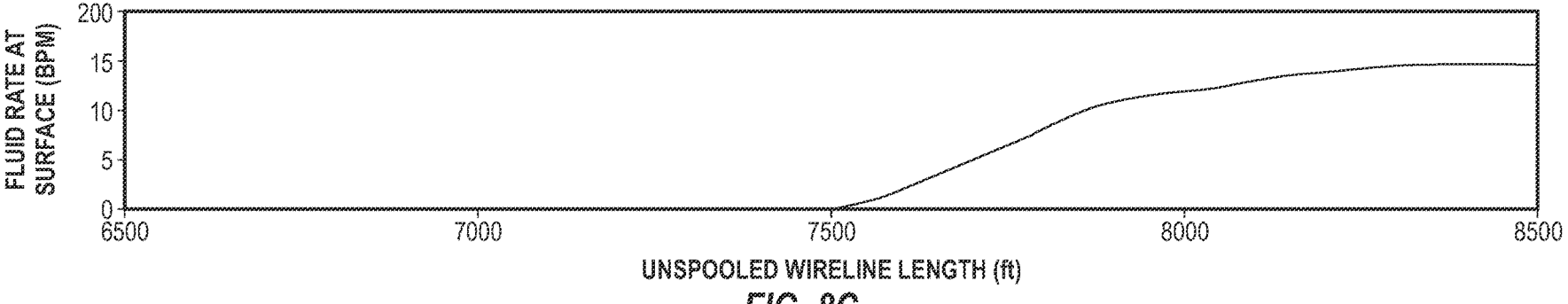

FIGS. 8*a*-8*c* show an example of an automated start of a pump down operation according to embodiments of the present disclosure. In embodiments, the algorithm has a range of values for the downhole wireline tension target for the winch unit and another range of values for the downhole wireline tension target for the pump unit, which are considered acceptable to continue the operation in the curved section, as shown in the dotted line and semi-continuous line in FIG. 8*a*. As shown in FIG. 8*b*, when the unexpected offset of 300 lb (136 kg) downhole tension occurs, the winch unit doesn't react aggressively to the large downhole tension error and the winch speed does not change dramatically as indicated by the blee line. However, the pump unit ramps up the pumping rate to increase the fluid rate to add weight on downhole tool string 160 to compensate for the 300 lb (136 kg) weight loss. This way, downhole tool string 160 is not slowed down significantly as compared to the example in FIGS. 7*a*-7*c*, and the pump down operation can be performed in less time and fluid, and thus costs less money.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method for automating a start of a pump-down operation comprising:

lowering a downhole tool string into a wellbore via a wireline controlled by a winch unit and a pump unit;

measuring at least one measurement parameter;

calculating a first range of wireline tension reference for the winch unit from at least inputs comprising at least one user configuration parameter and the at least one measurement parameter, wherein calculating the first range of wireline tension reference for the winch unit comprises a wireline tension reference at downhole side for the winch unit ($T_{winch}$) equal to:

$$T_{winch} = \begin{cases} (W - \rho Vg) \times \cos\theta; (W - \rho Vg) \times \cos\theta \leq Tmeas \\ T_{meas}, [(W - \rho Vg) \times \cos\theta \geq Tmeas \geq T_{desired}] \\ T_{deisred}, Tmeas \leq T_{desired} \end{cases}$$

wherein W is the tool string weight, ρ is the density of the fluid in the wellbore, g is the gravity constant, V is the volume of the downhole tool string, θ is the inclination in degrees, $T_{meas}$ is the measured wireline tension, and $T_{desired}$ is the desired wireline tension reference for horizontal section;

calculating a second range of wireline tension reference for the pump unit different than the first wireline tension reference, wherein the second wireline tension reference is calculated from at least inputs comprising at least one user configuration parameter and the at least one measurement parameter, wherein calculating the second range of the wireline tension reference for the pump unit comprises a wireline tension reference for the pump unit ($T_{pump}$) equal to:

$$T_{pump} = \max((W - \rho Vg) \times \cos\theta, T_{desired}),$$

and is greater than a maximum possible value of the first wireline tension reference at a given depth;

generating a first tension error signal for the winch unit when a measured tension of the wireline deviates from the calculated range of wireline tension references for the winch unit;

modifying the first tension error signal with a speed error between recommended job speed and measured winch speed, wherein modifying the first tension error signal comprises reducing the first tension error signal to increase winch speed when the winch is not moving or running slower than the recommended job speed;

wherein modifying the first tension error signal comprises increasing the first tension error signal to reduce winch speed when the winch is running faster than the recommended job speed;

generating a tension error signal for the pump unit when a measured tension of the wireline deviates from the calculated range of wireline tension references for the pump unit; and adjusting the lowering of the downhole tool string in response to the tension error signal for the winch unit and/or the tension error signal for the pump unit.

2. The method of claim 1, wherein calculating the range of wireline tension references for the winch unit comprises calculating a target range of wireline tension reference for the winch unit for a horizontal section and calculating a target range of wireline tension reference for the winch unit for a curved section.

3. The method of claim 1, wherein calculating the range of wireline tension references for the pump unit comprises calculating a target wireline tension reference for the pump unit for a horizontal section and calculating a net weight of the downhole tool located at a curved section without pumping fluid and selecting the largest value of the two calculations as the upper range of the wireline tension reference for the pump unit.

4. The method of claim 2, wherein the measured tension of the wireline is above the calculated upper range of the wireline tension references for the winch unit for the curved section, and wherein adjusting the lowering of the downhole tool string in response to the tension error signal comprises instructing a winch unit to increase a line speed.

5. The method of claim 2, wherein the measured tension of the wireline is below the calculated lower range of wireline tension reference for the winch unit for the curved section, and wherein adjusting the lowering of the downhole tool string in response to the tension error signal comprises instructing a winch unit to reduce a line speed.

6. The method of claim 1, wherein calculating a range of wireline tension references for the winch unit comprises calculating a range of wireline tension references for the winch unit with the upper range being based at least on one measurement parameter with the downhole tool string located at a curved section and the lower range being based at least on one measurement parameter with the downhole tool string located in a horizontal section.

7. The method of claim 6, further instructing the winch unit to maintain a line speed when the measured tension of the wireline is within the calculated range of wireline tension references for the winch unit.

8. The method of claim 1, wherein calculating the range of wireline tension references for the pump unit comprises calculating a target wireline tension reference for the pump unit with the downhole tool string located at a curved section.

9. The method of claim 1, further instructing the pump unit to increase a pump rate when the measured tension of the wireline is below the desired wireline tension reference for the pump unit with the downhole tool string located at a curved section.

10. The method of claim 1, further instructing the pump unit to reduce a pump rate when the measured tension of the wireline is above the calculated upper range of the wireline tension references for the pump unit with the downhole tool string located at a curved section.

11. The method of claim 1, wherein the at least one user configuration parameter comprises at least one user configuration parameter selected from the group consisting of a tension reference, a downhole tool string weight, a downhole tool string volume, and any combination thereof.

12. The method of claim 1, wherein the at least one measurement parameter comprise at least one measurement parameter selected from the group consisting of a downhole tension of the wireline, an inclination of the downhole tool string, and any combination thereof.

* * * * *